US006520352B2

(12) United States Patent
Mondragon et al.

(10) Patent No.: US 6,520,352 B2
(45) Date of Patent: Feb. 18, 2003

(54) STACKABLE LAZY SUSAN HAVING CENTRAL SUPPORT COLUMN

(76) Inventors: Anna L. Mondragon, 4266 Encinitas Way, Union City, CA (US) 94587; Perez Mondragon, 1138 166th St., Gardena, CA (US) 90247

( * ) Notice: Subject to any disclaimer, the term of this patent is extended or adjusted under 35 U.S.C. 154(b) by 0 days.

(21) Appl. No.: 09/897,812

(22) Filed: Jul. 2, 2001

(65) Prior Publication Data

US 2003/0000903 A1 Jan. 2, 2003

(51) Int. Cl.[7] ..... A47F 5/02

(52) U.S. Cl. ..... 211/144; 211/129.1; 211/131.1; 211/163

(58) Field of Search ..... 211/144, 163, 211/28, 131.1, 129.1; D7/630

(56) References Cited

U.S. PATENT DOCUMENTS

| | | | | | |
|---|---|---|---|---|---|
| 2,507,951 | A | * | 5/1950 | Barnes | 211/129.1 |
| 3,972,419 | A | | 8/1976 | Short | 211/78 |
| 4,736,856 | A | * | 4/1988 | Alneng et al. | 211/131.1 |
| 5,487,600 | A | | 1/1996 | Griffin | 312/135 |
| 5,772,050 | A | * | 6/1998 | Shih | 211/163 |
| 5,894,944 | A | | 4/1999 | Swift | 211/78 |
| D420,852 | S | | 2/2000 | Demers | D7/501 |

* cited by examiner

*Primary Examiner*—Daniel P. Stodola
*Assistant Examiner*—Erica B. Harris
(74) *Attorney, Agent, or Firm*—Hensderson & Sturm LLP

(57) ABSTRACT

A multi-level support stand (10) including an enlarged base member (20) having a central aperture (21) that is dimensioned to receive the closed lower end (31) of an elongated cylindrical support member (30) having an open end (32) and an interior receptacle (33); wherein, the elongated cylindrical support member (30) is dimensioned to be received through central apertures (42) formed in a plurality of support tray members (40) (40') (40") each having an upper surface provided with a plurality of recesses (43) and downwardly depending stem elements (41) which vertically space the support tray members (40) (40') etc., from the base member (20) and each other in a rotatable relationship with the cylindrical support member (30).

4 Claims, 1 Drawing Sheet

STACKABLE LAZY SUSAN HAVING CENTRAL SUPPORT COLUMN

BACKGROUND OF THE INVENTION

1. Field of the Invention

The present invention relates to the field of multi-tiered support devices in general and in particular to a stackable lazy Susan style device having a unique central support column.

2. Description of Related Art

As can be seen by reference to the following U.S. Pat. Nos. Des. 420,852; 5,894,944; 3,972,419; and, 5,487,600 the prior art is replete with myriad and diverse multi-level support stands some of which contain relatively rotatable levels.

While all of the aforementioned prior art constructions are more than adequate for the basic purpose and function for which they have been specifically designed, they are uniformly deficient with respect to their failure to provide a simple, efficient, and practical arrangement wherein the central support column serves a dual function as both an axis of rotation for all of the vertically elevated support surfaces as well as defining a central reservoir for floral arrangements or in the alternative as a receptacle for other interchangeable decorative elements that would be visually observable through the translucent material from which the support stand was fabricated.

As a consequence of the foregoing situation, there has existed a longstanding need for a new and improved multi-level rotatable support stand that would incorporate the aforementioned novel central support column into its basic design and construction; and the provision of such a construction is a stated objective of the present invention.

BRIEF SUMMARY OF THE INVENTION

Briefly stated, the rotatable support stand that forms the basis of the present invention comprises in general a base unit, a central support unit and a plurality of rotatable support units.

As will be explained in greater detail further on in the specification, the base unit includes an enlarged generally flat base member provided with a central aperture that is dimensioned to fixedly receive the central support unit.

The central support unit comprises in general an elongated cylindrical support member having a closed lower end and an open upper end which define an elongated open mouthed receptacle that may optionally be provided with a decorative closure element.

In addition, each of the plurality of rotatable support units includes a dish-shaped support tray member having a downwardly depending stem element surrounding a central aperture wherein the upper surface of the dish-shaped support member is provided with a plurality of recesses adapted to receive disparate articles or foodstuffs and wherein the dish-shaped support tray members have different diameters and are adapted to be slidably received on the elongated cylindrical support member in a rotatable fashion to one another.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
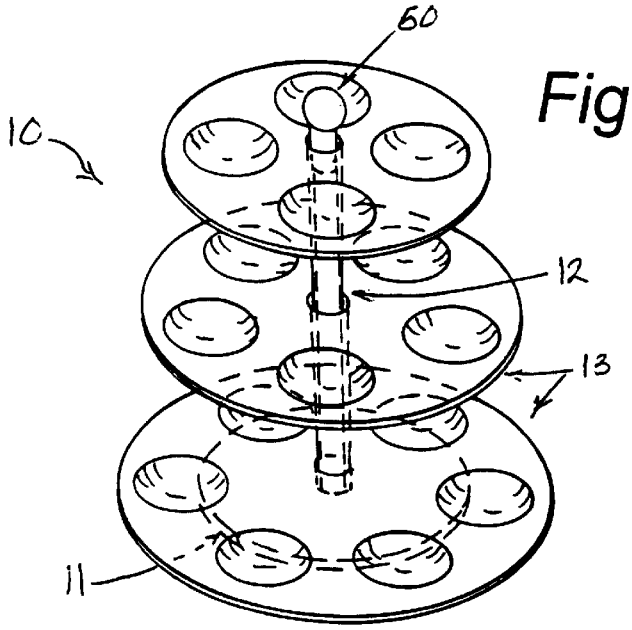
FIG. 1 is a perspective view of the multi-level rotary support stand that forms the basis of the present invention.

As can be seen by reference to the drawings, and in particularly to FIG. 1, the multi-level support stand that forms the basis of the present invention is designated generally by the reference number 10. The support stand comprises in general a base unit 11, a central support unit 12, and a plurality of rotatable support units 13. These units will now be described in seriatim fashion.

Figure 2:
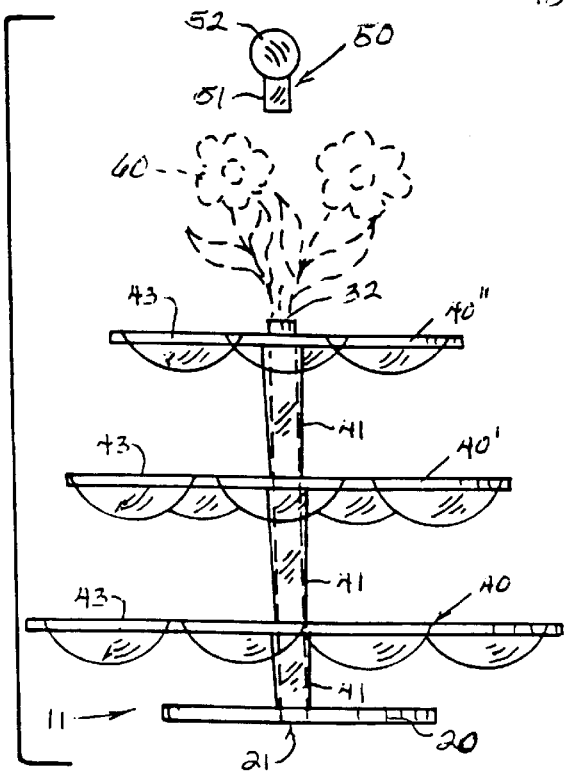
FIG. 2 is a side elevation view of the support stand.
Figure 3:
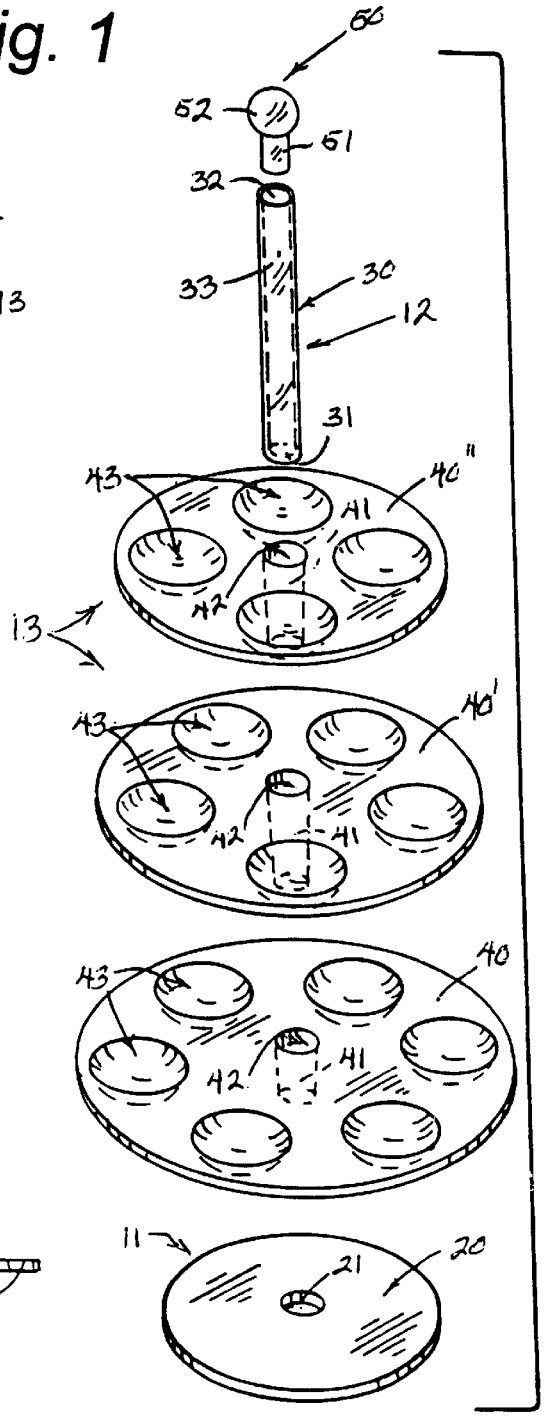
FIG. 3 is an exploded perspective view of the support stand.

As can best be appreciated by reference to FIGS. 2 and 3, the base unit 11 comprises an enlarged generally flat base member 20 provided with a central aperture 21 that is adapted to fixedly receive the lower portion of the central support unit 12.

The central support unit 12 in turn comprises an elongated generally hollow cylindrical support member 30 having a closed lower end 31 dimensioned to be received in the central aperture 21 in the base member 20 and an open upper end 32 wherein the interior of the cylindrical support member 30 defines a hollow receptacle 33 whose purpose and function will be described in greater detail further on in the specification.

Still referring to FIGS. 2 and 3, it can be seen that each of the plurality of rotatable support units 13 comprises a circular support tray member 40 having a downwardly depending stem element 41 surrounding a central aperture 42 that is dimensioned to slidably receive the cylindrical support member 30.

Furthermore, the upper surface of the circular support tray member 40 is provided with a plurality of recesses 43 dimensioned to receive diverse articles such as foodstuffs, jewelry, etc., wherein, each of the circular support tray member 40 40' 40" has different diameters which decrease in proportion to the location of the particular circular support tray member 40 etc., along the vertical axis of the central support member 30.

As shown in FIGS. 1 through 3, this invention also contemplates the optional use of a decorative cap member 50 in conjunction with the central support member 30; wherein, the cap member 50 has a lower downwardly depending stem element 51 which is dimensioned to fit into the open upper end 32 of the central support member 30 and an upper enlarged decorative element 52 which not only enhances the aesthetic appearance of the rotatable support stand 10, but also captively engages the support tray members 40 40' etc., on the central support member 30.

As can also be appreciated by reference to FIG. 2, when the decorative cap member 50 is not in use, the hollow receptacle 33 within the central support member 30 may be filled with water to sustain cut flowers 60 whose stems are inserted into the receptacle 33 or colored marbles, crystals, etc., that would produce an aesthetically pleasing effect as viewed through the clear plastic material from which the support stand is fabricated.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A multi-level rotatable support stand comprising:

a base unit including an enlarged base member provided with a central aperture a central support unit including an elongated one-piece hollow cylindrical support member having a closed lower end and an open upper end wherein the closed lower end of the cylindrical support member is dimensioned to be fixedly received in the central aperture in the base member; and, a plurality of rotatable support units wherein each rotatable support unit includes a support tray member having a downwardly depending stem element that surrounds a central aperture that is dimensioned to rotatably receive the cylindrical support member.

2. The rotatable support stand as in claim 1; wherein, each support tray member has an upper surface provided with a plurality of recesses.

3. The rotatable support stand as in claim 2; wherein, each of the tray members has a generally circular configuration.

4. The rotatable support stand as in claim 3; wherein, the outside diameters of each support tray member are different from the outside diameters of the other support tray members.

* * * * *